US008997659B2

(12) United States Patent
Leduc

(10) Patent No.: US 8,997,659 B2
(45) Date of Patent: Apr. 7, 2015

(54) FURNITURE ELEMENT COMPRISING AN ARTICULATED PLATE OF VARIABLE SURFACE

(71) Applicant: La Coupe International, Ltd., Southampton, NY (US)

(72) Inventor: Michel Leduc, Falaise (FR)

(73) Assignee: La Coupe International, Ltd., New York, NY (US)

( * ) Notice: Subject to any disclaimer, the term of this patent is extended or adjusted under 35 U.S.C. 154(b) by 0 days.

(21) Appl. No.: 13/915,537

(22) Filed: Jun. 11, 2013

(65) Prior Publication Data

US 2013/0340654 A1 Dec. 26, 2013

(30) Foreign Application Priority Data

Jun. 12, 2012 (FR) ..... 12 55485

(51) Int. Cl.
*A47B 1/02* (2006.01)
*A47B 9/00* (2006.01)
*A47B 13/08* (2006.01)

(52) U.S. Cl.
CPC ... *A47B 1/02* (2013.01); *A47B 9/00* (2013.01); *A47B 13/088* (2013.01)

(58) Field of Classification Search
CPC ..... A47B 1/02; A47B 2001/035; A47B 1/03; A47B 1/056; A47B 1/08
USPC ..... 108/83–86, 67, 68, 137, 87, 89; 248/602, 346.06, 346.07
See application file for complete search history.

(56) References Cited

U.S. PATENT DOCUMENTS

| | | | | | |
|---|---|---|---|---|---|
| 651,638 | A | * | 6/1900 | Norris | 108/145 |
| 687,712 | A | * | 12/1901 | DApery | 108/83 |
| 737,805 | A | * | 9/1903 | Wehn | 108/84 |
| 818,560 | A | * | 4/1906 | Nichols | 28/213 |
| 829,439 | A | * | 8/1906 | Simone | 108/66 |
| 1,680,664 | A | * | 8/1928 | Cleveland | 108/67 |
| 1,751,952 | A | * | 3/1930 | Siskin | 108/67 |
| 1,773,470 | A | * | 8/1930 | Bellonby | 108/87 |
| 1,778,666 | A | * | 10/1930 | Fox | 108/85 |
| 1,937,250 | A | * | 11/1933 | Hassel et al. | 108/85 |
| 1,969,190 | A | * | 8/1934 | Mowrey et al. | 108/77 |
| 2,007,475 | A | * | 7/1935 | Miller | 108/84 |
| 2,101,725 | A | * | 12/1937 | Traficante | 108/83 |
| 3,738,286 | A | * | 6/1973 | Hoffman | 108/147.22 |
| 4,494,466 | A | * | 1/1985 | Synek et al. | 108/85 |
| 5,156,095 | A | * | 10/1992 | Hansbaek et al. | 108/66 |

FOREIGN PATENT DOCUMENTS

| | | |
|---|---|---|
| FR | 2593044 | 7/1987 |
| FR | 2705212 | 11/1994 |
| WO | WO 89/10710 | 11/1989 |

* cited by examiner

*Primary Examiner* — Janet M Wilkens
(74) *Attorney, Agent, or Firm* — Blakely Sokoloff Taylor & Zafman

(57) ABSTRACT

A furniture element forming a table (1) including a base box (2) and several coplanar main plates mobile in circular translation in a common plane. A mechanism (4) enables synchronized displacement in the common plane, wherein the plates (3) can assume at least two relative configurations, one in which they combine to form a full plate, the other in which the plates jointly define a central space 51. A mobile central plate (5) can be displaced according to an axis perpendicular to the plane defined by the main plates (3), to move from a low position in which the central plate (5) is retracted by the main plates (3) to a high position in which it is placed in the plane of the main plates (3) at the level of the central space (51), forming a full plate with the main plates (3).

8 Claims, 5 Drawing Sheets

FURNITURE ELEMENT COMPRISING AN ARTICULATED PLATE OF VARIABLE SURFACE

FIELD OF THE INVENTION

The present invention relates to the general field of furniture elements having a plane surface designed to support objects and more particularly elements of furniture where the plane surface can assume different configurations.

PRIOR ART

Tables are already known which comprise several mobile plates likely to be displaced relative to each other to allow uses of these tables according to different configurations.

In particular, there is a furniture element forming a table comprising a base box and several coplanar main plates, mobile in circular translation in their common plane. A mechanism enables their synchronised displacement in their common plane. Thanks to this mechanism, the plates can assume at least two relative configurations, one in which they combine to form a full plate, the other in which the plate which they jointly define comprises a central recess.

The plane surface, designed to support objects, of such a furniture element can assume different configurations. But regardless of the configuration, this surface retains the same surface area. Such a furniture element therefore cannot vary the surface area of the surface designed to support objects. Also, the central recess present in some configurations of such a furniture element represents an added risk whereby some objects placed on the plane surface will fall.

EXPLANATION OF THE INVENTION

The invention provides a furniture element forming a table having a plane surface which can assume different configurations and which does not have the disadvantages of the prior art. For this the invention proposes a furniture element forming a table comprising a base box and several coplanar main plates, these main plates being mobile in circular translation in their common plane, a mechanism enabling their synchronised displacement in their common plane, said plates which can assume, because of this mechanism, at least two relative configurations, one in which they combine to form a full plate, the other in which the plate which they jointly define comprises a central space.

This element forming a table further comprises a central plate mobile capable of being displaced according to an axis perpendicular to the plane defined by the main plates, to shift from a low position in which said central plate is arranged below the main plates and is retracted by the latter to a high position in which it is placed in the plane of said main plates at the level of the central space, the central plate forming with the main plates a full plate.

Advantageously, it also comprises a mechanism which raises or lowers the central plate synchronised relative to displacement of the main plates, the circular translation movement of the main plates causing, because of this mechanism, translation movement of the central plate according to an axis perpendicular to the plane defined by the main plates.

DESCRIPTION OF THE FIGURES

Other aims, characteristics and advantages will emerge from the following detailed description in reference to the drawings given by way of illustration and non-limiting, in which.

DETAILED DESCRIPTION OF THE INVENTION

Figure 1:
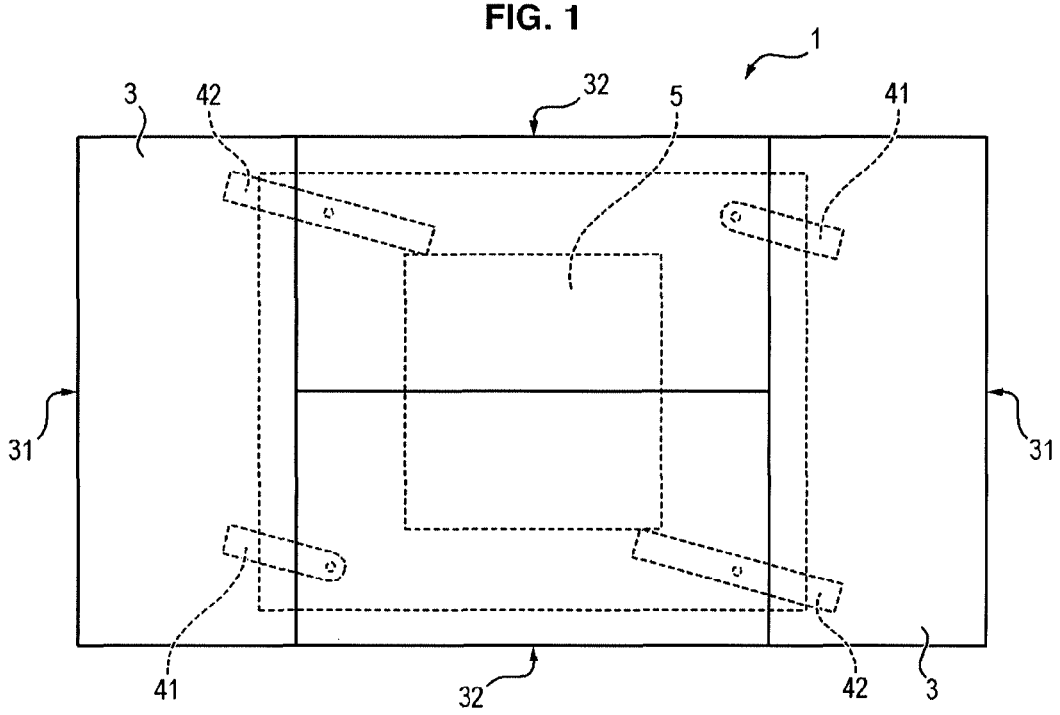
FIG. 1 is a sectional view in the plane of the main plates of an example of an element forming a table according to the invention in a first configuration.
Figure 2:
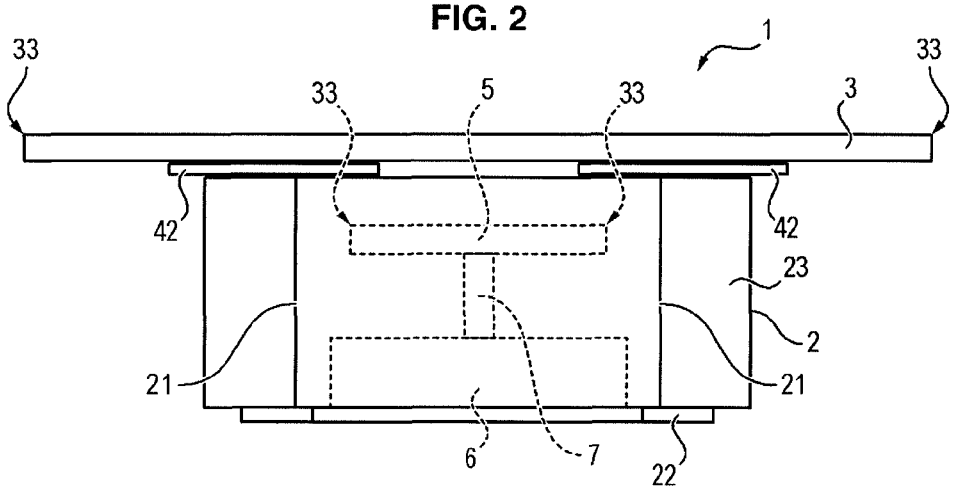
FIG. 2 is a sectional view of the furniture element forming a table of FIG. 1 in the configuration of FIG. 1 according to a plane transverse to the plane of FIG. 1.

An example of a furniture element forming a table according to the invention is described hereinbelow in reference to FIGS. 1 to 7.

The furniture element forming a table 1 comprises a base box 2, several mobile main plates 3, several support feet 21 integrated into said box 2, and a mechanism 4 interposed between the support feet 21 and the plates 3 and enabling displacement of the plates 3 in their common plane.

In particular, because of this mechanism 4 said plates 3 can assume at least two relative configurations, one in which they combine to form a full plate (closed configuration), the other in which the plate which they jointly define comprises a central space 51 (deployed configuration), The furniture element forming a table 1 comprises also a central plate 5 guided by two jacks 7, typically formed from columns comprising two elements sliding into each other, as well as elements of a mechanism 6 for moving said central plate 5 perpendicularly to the plates 3, to shift from a low position in which said central plate 5 is arranged below the main plates 3 and is retracted by the latter to a high position in which it is placed in the plane of said main plates 3 at the level of the central space 51, the central plate 5 now forming a full plate with the main plates 3.

The base box 2 can comprise a plane plinth 22 of rectangular form, of a dimension slightly less than that occupied by the main panels 3 when they are in their closed configuration. This plinth 22 is placed on the floor, for example on casters which enable it to be moved. It can be made of wood or marble or any other material having adequate resistance to bear the support feet 21, the jacks 7 and mechanism 6. If necessary, it is closed by panels 23 for masking and protecting the elements it contains and especially the principal mechanism 6.

There are two main plates 3 in the example illustrated in the figures. These two plates 3 are identical and in this case each have an L form, the feet 31 of the L forms of these plates 3 and the back 32 of the same forms being dimensioned to fit neatly into the closed position of the plates 3 and jointly form a full plate. In particular, the width of the part 32 of a plate 3 which forms the back of the L is equal to half the length of the part 31 forming the foot of the L of this same plate.

On their contour and in the extension of the inner side of the part 32 which forms the foot of the L, the main plates 3 have a metal rim 33 slightly elevated relative to the surface of the main plates 3. These metal rims 33 prevent any objects placed on these plates from falling and delimit for each main plate 3 two rectangular surfaces, one first having a width of 290 cm and a length of 780 cm, and a second having a width of 390 cm and a length of 650 cm.

The main plates 3 are likely to be displaced in their common plane so that they can move from one configuration to another.

For this purpose, the mechanism 4 comprises four connecting rods 41, 42 borne by the four feet 21. The feet 21 are rods in rotation placed on means of the ball bearing type carried by the plinth 22. Two of the connecting rods (connecting rods 41) are fixed to two diagonally opposite feet 21. Each of these connecting rods 41 extends on either side of the axis of rotation of the corresponding foot 21 by being articulated respectively at one and the other of its two ends on one and the other of the two plates 3. The two connecting rods 42 as such are fixed to the two other feet 21. They each extend from a single side of the axis of rotation of the corresponding foot 21 and are each articulated to a different plate 3.

On each of the two plates 3, the distance separating the fastening points of each of the main connecting rods 41 is equal to the distance separating the two axes of rotation of the corresponding feet 21.

This type of mechanism 4 forces the two main plates 41 into circular translation movement in their common plane, the displacement of one of the main plates 3 causing symmetrical displacement of the other of the main plates 3.

The secondary connecting rods 42 as such better distribute the weight of the main plates 3 and reinforce the resistance of the mechanism 4 which coordinates their displacement.

Figure 3:
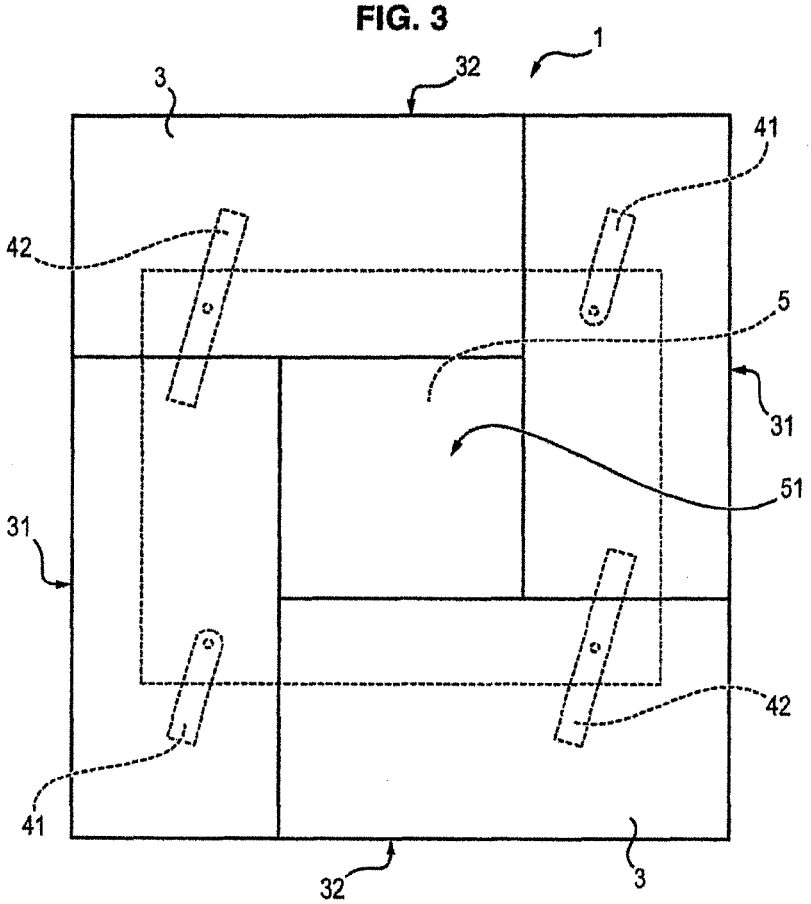
FIG. 3 is a sectional view in the plane of the main plates of a furniture element forming a table of FIG. 1 in a second configuration.
Figure 4:
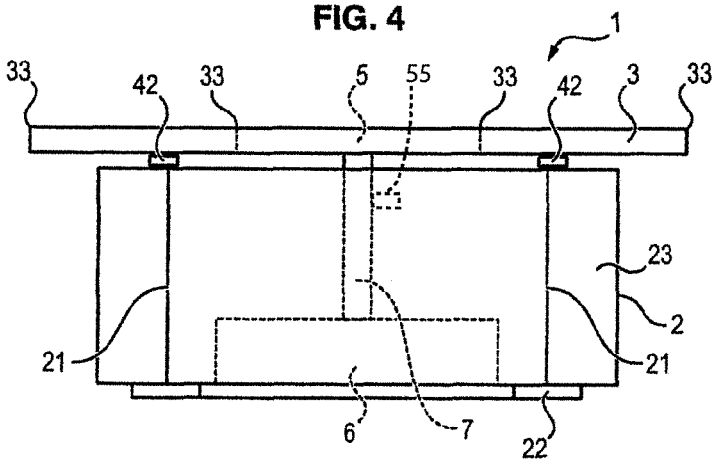
FIG. 4 is a sectional view of the furniture element forming a table of FIG. 1 in the configuration of FIG. 3 according to a plane transverse to the plane of FIG. 3.
Figure 5:
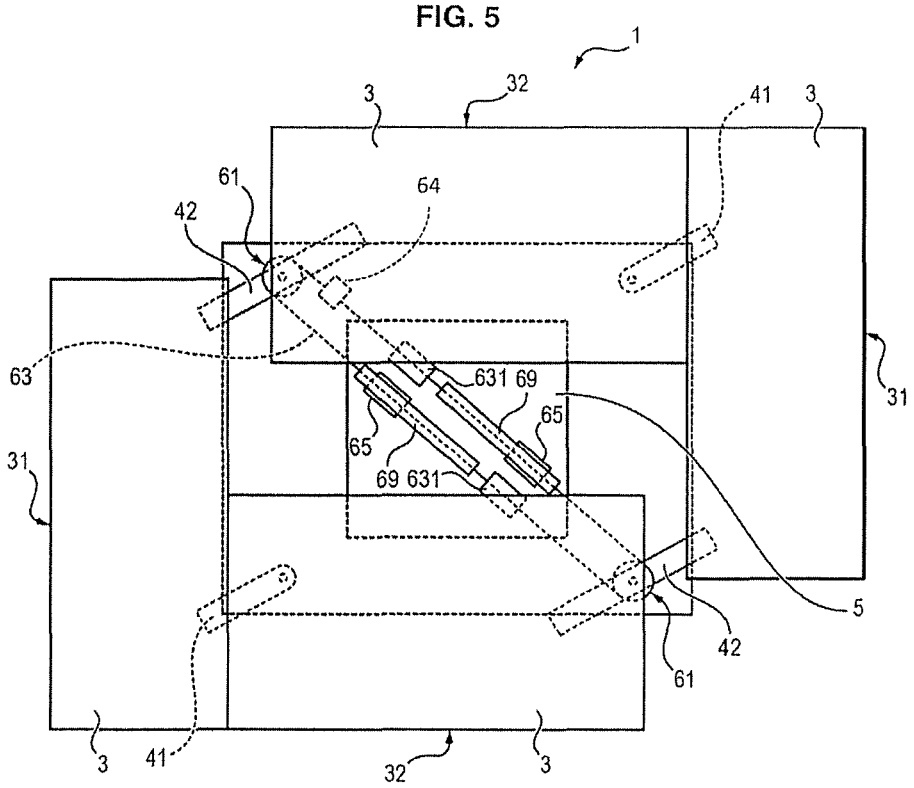
FIG. 5 is a sectional view in the plane of the main plates of a furniture element forming a table of FIG. 1 in an intermediate configuration between the configuration of FIG. 1 and the configuration of FIG. 3.
Figure 6:
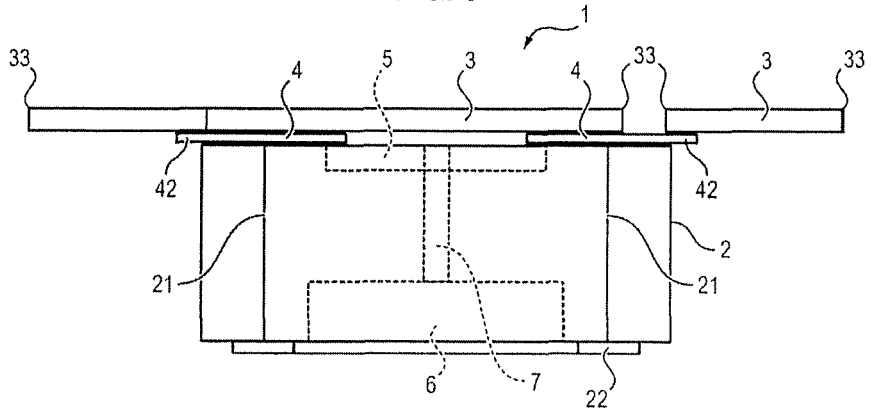
FIG. 6 is a sectional view of the furniture element forming a table of FIG. 5 in the configuration of FIG. 5 according to a plane transverse to the plane of FIG. 5.
Figure 7:
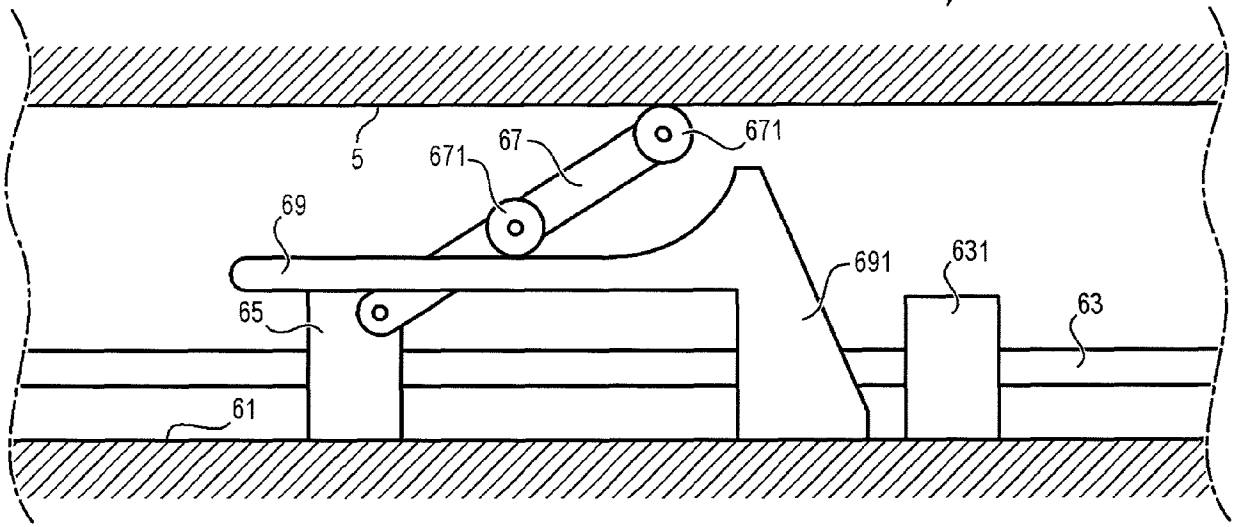
FIG. 7 is a view of the raising mechanism in the low position of the central plate corresponding to FIGS. 1 and 2.
Figure 8:
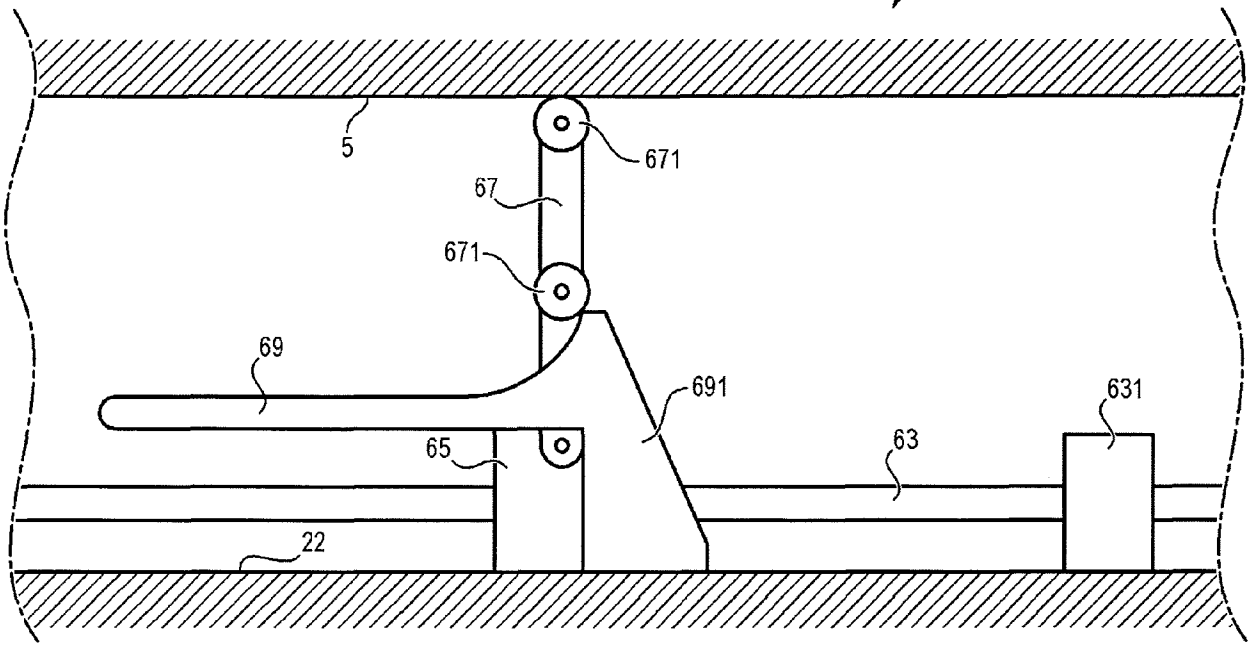
FIG. 8 is a view of the mechanism which raises or lowers the central plate synchronised relative to displacement of the main plates when the carriage is stopped against the ramp.

By way of this mechanism 4, the main plates 3 can assume at least two relative configurations, a first configuration shown in FIG. 1, in which they combine to form a full plate, a second configuration shown in FIG. 3, in which the plate which they jointly define comprises a central space 51 of rectangular form.

The furniture element forming a table 1 as described also comprises a central plate 5 of rectangular form, the dimensions of which correspond to those of the central space 51 defined by the main plates 3 in their second configuration. Similarly to the main plates 3 this central plate 5 has a metal rim 33 slightly elevated relative to its surface. These metal rims 33 prevent any objects placed on this plate from falling.

This central plate 5 is positioned to the right of the zone of the table corresponding to the central space 51. It is raised or lowered to occupy this central space 51 when the main plates 3 are in a deployed position and be retracted under the main plates 3, inside the base box 2, when the two plates 3 are closed on each other and form the full plate.

In particular, a mechanism 6 can be provided which raises or lowers the central plate 5 synchronised relative to displacement of the main plates 3, because of this mechanism 6 the circular translation movement of the main plates 3 causing translation movement of the central plate 5 according to an axis perpendicular to the plane defined by the main plates 3.

Near the plinth 22, the two feet 21 which constitute the axes of rotation of the connecting rods 41 each have a toothed wheel 61. The mechanism 6 further comprises a toothed belt 63 cooperating with the two toothed wheels 61 extending to form a loop between the latter. In this way, rotation of the toothed wheels 61 causes rotation of the toothed belt 63.

The mechanism 6 further comprises two carriages 65. The carriages 65 are fixed to the toothed belt 63, each on a rectilinear segment different to the travel of the latter, so that the two carriages 65 are driven in displacement by the movement of the belt 63 in opposite directions. Each of the carriages 65 is equipped with casters, for example two casters, which allow it to roll on the plinth 22 of the base box 2.

Each of the carriages 65 is located under a ramp 69, typically a double ramp, which guides it in its displacement. A foot 691, fixed on the plinth 22 at the level of the travel of the belt 63, bears the ramp 69. This foot 691 has a slot which allows the belt 63 to pass through. The carriage is limited in its displacement by the foot 691 of the ramp 69 against which it stops, or by the end of translation of the main plates 3.

In the opposite direction displacement of the carriage is also limited by the end of translation of the main plates 3, which avoids disengagement of the carriage 65 relative to the guiding of the ramp 69. Also, a stop 631 is advantageously fixed to the toothed belt 63 of the other side of the foot 691 of the ramp 69 to propose added limitation of the displacement of the carriage and consequently secure the mechanism.

Mounted on each carriage 65 is an arm 67 pivoting relative to the carriage 65. Each arm is fixed, by one of its ends, in rotation to the carriage in a plane perpendicular to the central element and containing the axis of translation of the carriage. Two rollers 671 are fixed to the centre of the each arm 67 on either side of the arm 67 and two others to the free end of each arm 67. These rollers 671 are in rotation about an axis perpendicular to the plane of rotation of the carriage 65.

Each arm 67 supports the mobile central plate 5 by means of the rollers 671 fixed at its free end 5. Also, each arm is supported on a guide ramp 69 by means of the rollers 671.

The rollers 671 are adapted to roll on the guide ramp 69 and on the lower face of the central plate 5.

The guide ramp 69 has a first part parallel to the plinth 22 of the base 2 and a second part inclined upwards such that displacement of the carriage 65 causes progression of the arm 67 about the carriage 65, typically progressive rotation, so as to cause displacement of the central plate 5 vertically.

In this way, circular translation of the main plates 3 causes rotation of the toothed wheels 61 and therefore movement of the toothed belt 63, which in turn causes displacement of the carriage 65, progressive rotation of said arm 67 about the carriage 65 and displacement of the central plate 5 from the high position to the low position or vice versa.

The drop of the guide ramp 69 is greater than the length of the segment of the arm 67 between the carriage 65 and the rollers 671 which slide on the guide ramp 69. The rollers 671 therefore cannot reach the apex of the guide ramp 69 and the arm 67 cannot tilt on the other side of the guide ramp 69.

The embodiment described further comprises two jacks 7 for guiding the central plate 5 in translation according to an axis perpendicular to the plane defined by the main plates 3.

In alternative embodiments, the different mobile elements of the table can have movements different to those described previously. In particular, displacement of the central plate according to an axis perpendicular to the plane defined by the main plates 3 can be accompanied by horizontal translation movement or by a tilting movement so it is arranged in a low position in a placement intended for it. The furniture element forming a table can also comprise a system 55 for blocking the main plates and the central plate when the latter is in a high position. This blocking system can especially comprise a holding system via spring-loaded roller on a two-position cam.

The embodiment described further comprises a system 64 for damping the movement of the different mobile parts.

This system for damping can especially comprise elastic return elements attached to mobile parts for damping movement, typically a strap and spring acting on the periphery of the external diameter of the toothed pulley fitted with its belt.

The invention claimed is:

1. A furniture element forming a table (1) comprising:

a base box (2) and several coplanar main plates (3), which are mobile in a circular translation in a common plane, a displacement mechanism (4) enabling synchronised displacement of the main plates in the common plane, wherein said plates (3) can assume, because of this mechanism (4), at least two relative configurations, one in which they combine to form a full plate, the other in which the plate they jointly define comprises a central space (51), a mobile central plate (5);

a raising and lowering mechanism (6) which raises or lowers the central plate (5) synchronised relative to displacement of the main plates (3), the circular translation movement of the main plates (3) causing, because of raising and lowering mechanism (6), translation movement of the central plate (5) according to an axis perpendicular to the plane defined by the main plates (3), from a low position in which said central plate (5) is arranged below the main plates (3) and is retracted by the latter to a high position in which it is placed in the plane of said main plates (3) at the level of the central space (51), the central plate (5) now forming a full plate with the main plates (3).

2. The furniture element forming a table (1) according to claim 1, wherein the mechanism (6) which raises or lowers the central plate (5) synchronised relative to displacement of the main plates (3) comprises:

toothed wheels (61) driven in rotation by the circular translation of the main plates (3), a toothed belt (63) cooperating with its toothed wheels (61) extending between the latter, at least one carriage (65) fixed to the toothed belt (63) on a rectilinear segment of the travel of the latter, the carriage (65) being driven in displacement by the movement of the toothed belt (63), on each carriage (65), an arm (67) mounted to pivot on the carriage (65), said arm (67) supporting all or part of the mobile central plate (5) and being supported by a roller (671) sliding on a guide ramp (69) on which it slides, said guide ramp (69) being configured such that displacement of said carriage (65) causes progressive rotation of said arm (67) about the carriage (65) so as to cause displacement of the central plate (5).

3. The furniture element forming a table (1) according to claim 2, further comprising two carriages (65) fixed on separate segments of the toothed belt (63) in movement in opposite directions.

4. The furniture element forming a table (1) according to claim 2 or claim 3, wherein the carriages (65) roll on the base box (2).

5. The furniture element forming a table (1) according to claim 2 or claim 3, wherein the carriages (65) are placed under a ramp (69) and guided in their displacement by the latter.

6. The furniture element forming a table (1) according to claim 1, further comprising guide elements for displacement of the central plate (5) in translation according to an axis perpendicular to the plane defined by the main plates (3).

7. The furniture element forming a table according to claim 1, further comprising a system for blocking the main plates and the central plate when the latter is in the high and low position.

8. The furniture element forming a table according to claim 1, further comprising a system for damping movement of the different mobile parts comprising elastic return elements attached to mobile parts for damping movement.

* * * * *